US005815790A

United States Patent [19]

Billgren et al.

[11] Patent Number: 5,815,790

[45] Date of Patent: Sep. 29, 1998

[54] METHOD RELATING TO THE MANUFACTURING OF A COMPOSITE METAL PRODUCT

[75] Inventors: Per Billgren, Söderfors; Kaj Embretsen, Edsbyn, both of Sweden

[73] Assignee: Soderfors Powder Aktiebolag, Soderfors, Sweden

[21] Appl. No.: 676,261

[22] PCT Filed: Jan. 12, 1995

[86] PCT No.: PCT/SE95/00020

§ 371 Date: Dec. 4, 1996

§ 102(e) Date: Dec. 4, 1996

[87] PCT Pub. No.: WO95/19861

PCT Pub. Date: Jul. 27, 1995

[30] Foreign Application Priority Data

Jan. 19, 1994 [SE] Sweden ..... 9400127

[51] Int. Cl.[6] ..... B22F 7/04

[52] U.S. Cl. ..... 419/5; 419/6; 419/8; 419/23; 419/26; 419/28; 419/49

[58] Field of Search ..... 419/5, 6, 7, 8, 419/9, 49, 23, 28, 26; 428/547, 548, 553, 554, 557, 558, 559, 562, 563

[56] References Cited

U.S. PATENT DOCUMENTS

| | | | |
|---|---|---|---|
| 3,280,614 | 10/1966 | Cordray et al. | 72/363 |
| 3,753,704 | 8/1973 | Manilla et al. | 75/208 R |
| 3,778,875 | 12/1973 | Morabito | 29/160.6 |
| 4,050,143 | 9/1977 | Aslund | 29/420.5 |
| 4,065,302 | 12/1977 | Turillon | 75/208 R |
| 4,259,413 | 3/1981 | Taglag et al. | 428/548 |
| 4,261,745 | 4/1981 | Watanabe et al. | 75/208 R |
| 4,399,611 | 8/1983 | Maringer | 30/350 |
| 4,581,202 | 4/1986 | Kudo et al. | 419/2 |
| 4,581,300 | 4/1986 | Hoppin, III et al. | 428/546 |
| 4,601,878 | 7/1986 | Aslund et al. | 419/49 |
| 4,602,952 | 7/1986 | Greene et al. | 75/228 |
| 4,606,884 | 8/1986 | Gavinet et al. | 419/27 |
| 4,844,863 | 7/1989 | Miyasaka et al. | 419/8 |
| 4,881,430 | 11/1989 | Hubbard | 76/104 R |
| 4,966,748 | 10/1990 | Miyasaka et al. | 419/8 |
| 5,069,886 | 12/1991 | Ekbom | 419/6 |
| 5,350,637 | 9/1994 | Ketcham et al. | 428/539.5 |

FOREIGN PATENT DOCUMENTS

| | | | |
|---|---|---|---|
| 0072175 | 2/1983 | European Pat. Off. | B22F 7/06 |
| 0157509 | 10/1985 | European Pat. Off. | B22F 1/00 |
| 0524710 | 1/1993 | European Pat. Off. | B22F 5/00 |
| 1752757 | 8/1974 | Germany | B22F 3/20 |
| 2419014 | 10/1979 | Germany | B22F 3/20 |

OTHER PUBLICATIONS

Patent Abstracts of Japan, vol. 7, No. 1, M–183, Abstract of JP, A, 57–161004 Guroorii K.K.), Oct. 4, 1982, see also the patent doc. especially the figures.

Industrial Heating, Jan. 1981, C. Aslund et al. "Extrusion and Hot Isostatic Pressing of Parts from Stainless Steel and Nickel Base Powders".

*Primary Examiner*—Daniel J. Jenkins

*Attorney, Agent, or Firm*—Michael D. Bednarek; Kilpatrick Stockton LLP

[57] ABSTRACT

The invention relates to a method for the manufacturing of a composite metal product. More particularly, the invention relates to a method for the manufacturing of a composite product consisting of at least two stainless steel materials having different chemical compositions, particularly a composite stainless product on which decorative patterns can or has been produced by etching.

It is significant feature of the invention that at least two stainless steel materials having different chemical compositions are bonded together through hot isostatic compaction at a pressure exceeding 600 bar and a temperature exceeding 1000° C., at least one of said materials consisting of powder, for the achievement of a consolidated body.

20 Claims, 3 Drawing Sheets

Fig.2
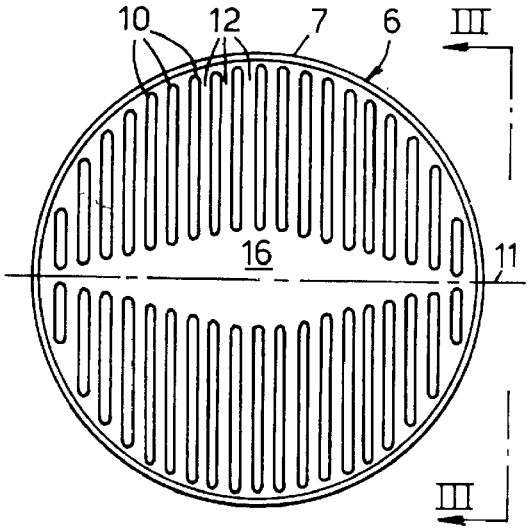
Fig.4.
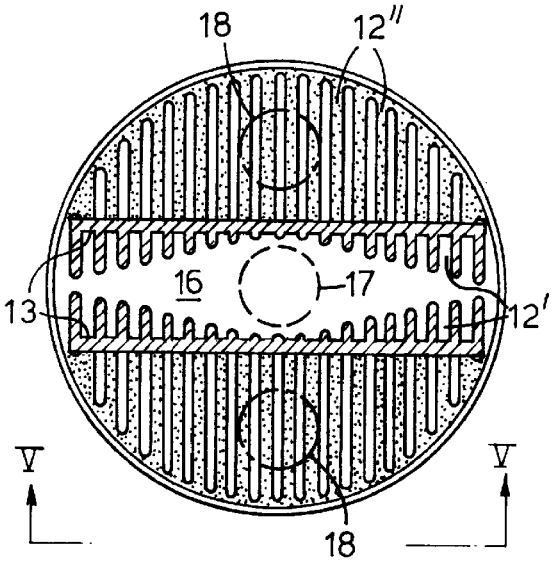
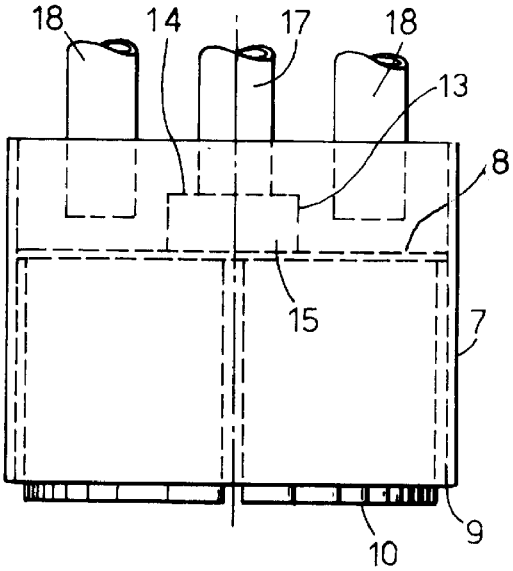
Fig.3.
Fig.5.
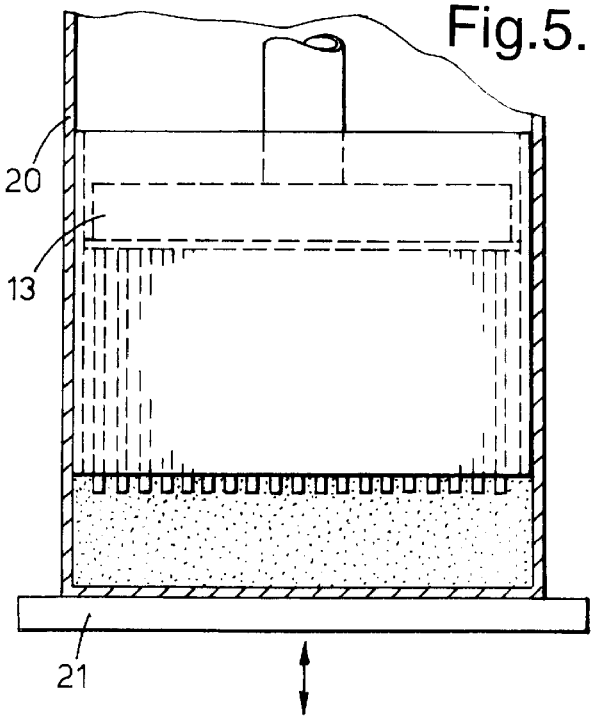

METHOD RELATING TO THE MANUFACTURING OF A COMPOSITE METAL PRODUCT

TECHNICAL FIELD

The invention concerns a method relating to the manufacturing of a composite metal product. More particularly, the invention concerns a method for the manufacturing of a composite article consisting of at least two stainless steel materials having different chemical compositions, particularly a composite stainless article on which a decorative pattern may or has been produced by etching.

BACKGROUND OF THE INVENTION

A number of conventional techniques exist for bounding together metal alloys to achieve composite products. Among these techniques, in the first place forge welding should be mentioned, wherein two or more heated blanks are welded together through forging or hot rolling. This technique is widely used for the manufacturing of compound steel wherein e.g. an unalloyed or a low-alloyed construction steel is bounded to a stainless steel for the production of a composite product. As far as composite products consisting of two or more stainless steels having different chemical compositions are concerned, the possibility to use forge welding, however, is limited because it from technical reasons is difficult to bound stainless steels of different types together through forge welding, for example martensitic and austenitic stainless steels.

Old sword-blades and knife-blades from iron age and medieval time sometimes exhibit decorative patterns having varying chemical composition within a single piece of iron. Artifacts from oldest times exhibit patterns obtained as a result of the metallurgical processes used at that time. So called wootz forgings have patterns which are achieved through slow cooling of hypereutectic carbon steels; other types are the result of a technique in which liquid steel droplets having different chemical compositions are caused to solidify to form a forging blank. Later the smiths learned how to bound steel pieces in form of layers having different chemical compositions by forge welding so that patterns of high artistic quality could be produced through etching subsequent to plastic working and kneading. Such articles, usually referred to as damascened (Damascus) forgings dominating the weapon industry from early medieval time to Viking time, basically because these compound materials could combine a tough blade with a hard, wear resistant edge material. Still the forge welding technique is used for the production of exclusive knife-blades and sword-blades, but only such steel types can be used which have a sufficient hot workability and which can be bonded together by forge welding. This means that it has not been possible to manufacture stainless knife- or sword-blades having damascened patterns through classic or conventional technique. Instead the choice of material has been restricted to low alloyed materials, possibly with the addition of phosphorus or nickel for the achievement of a sufficient contrast after etching.

BRIEF DISCLOSURE OF THE INVENTION

It is the purpose of the invention to suggest a method for the manufacturing of a composite metal product, which has not the above mentioned restrictions. The invention is based on the concept that at least one of the stainless steel materials consists of powder and that the two stainless steel materials are bonded to form a consolidated body through hot isostatic compaction, so called HIP-ing, at a pressure exceeding 600 bar and a temperature exceeding 1000° C.. Suitably a powder is used which is produced through so called atomizing, which means that a stream of molten metal is disintegrated to droplets by means of an inert gas, whereafter the droplets are caused to solidify to form a powder in the inert gas. Thereafter the powder is sieved to a particle size of max. 1 mm The HIP-ing can be performed through conventional hot isostatic pressing, wherein the different materials which shall be bonded to each other, at least one of said materials consisting of a powder, is placed in a closed capsule, from which the air is evacuated, whereafter the capsule is subjected to the hot isostatic pressing. The capsule conventionally can consist of a metal sheet, e.g. carbon steel sheet, but it is also conceivable that the capsule at least partly consists of stainless steel which could form an integrated part of the finished product. Also capsules made of non-metallic materials can be conceived, e.g. glass, enamel, etc.

A conceivable processing may consist of production of powder through so called atomizing, filling two or more different kinds of powder in a capsule, preferably in selected patterns, preferably in a metal sheet capsule; compaction to full density through hot isostatic pressing; extrusion or forging the consolidated body; and thereafter continued plastic working to the shape of a bar, strip or plate; and etching in order to develop the decorative effect.

If desired, also purely functional effects may be achieved through the invention, e.g. a high edge hardness of a cutting tool in combination with an excellent corrosion resistance and toughness of the tool as a whole. According to another aspect of the invention, purely decorative effects can be achieved, which can be used for the production of ornamental articles or useful articles having a certain aesthetic value, i.e. cutlery, trays, ash-trays, and other house hold utensils; furnishing- and construction material etc. Further it is possible, according to still another aspect of the invention, to achieve as well functional as decorative effects, i.e. a high edge hardness of a knife in combination with excellent corrosion resistance and toughness of the whole knife blade and at the same time a high aesthetic value through a damascening like pattern. In order to achieve a decorative effect, the stainless materials are chosen with such different compositions that the desired contrast effect is achieved after etching. For example a first stainless steel may consist of a martensitic, comparatively high carbon stainless steel, which has a limited corrosion resistance and which therefore is readily etched and strongly dark coloured by an acid, at the same time as it is suited as an edge material, while a second stainless steel suitably consists of a more corrosion resistant, low-carbon stainless steel, which is less etched than the martensitic, high-carbon stainless steel, e.g. an austenitic, ferritic, or ferritic-austenitic stainless steel, or possibly a martensitic stainless steel having a substantially much lower carbon content than the said first stainless steel, which preferably shall form the edge. In principle, according to the invention, also two stainless steel grades of the same type can be conceived, i.e. martensitic stainless steels, wherein the steels have the same chemical composition with the exception that one of the steels, as distinguished from the other steel, is alloyed with one or more elements, or contains a substantially higher amount of this or these elements, e.g. phosphorus, which has the effect that this steel is etched substantially much more than the other steel for the purpose of achieving the desired contrast effect.

Further characteristic features and aspects of the invention will be apparent from the appending claims and from the following description of some conceivable ways of performing the method according to the invention.

BRIEF DESCRIPTION OF DRAWINGS

In the following description of some conceivable embodiments of the method of the invention, reference will be made to the accompanying drawings, in which

FIG. 2 is a view from underneath of a tool which can be used for charging two different powders to form layers in a capsule;

FIG. 3 shows the same tool in a view along the line III—III in FIG. 2;

FIG. 4 is a top view of the tool;

FIG. 5 is a view along the line V—V in FIG. 4;

EXAMPLE 1

A first powder of a martensitic stainless tool steel was produced through atomizing a stream of the molten metal. The metal had the following nominal composition: 1.70 C, 17 Cr, 1 Mo, 3V, 0.4 Si, 0.3 Mn, balance iron and normal amounts of impurities and accessory elements. The powder was sieved to a maximal particle size of 1 mm. Flakes with varying sizes and shapes were made form a second stainless steel which was of an austenitic type. Typically, the flakes had a thickness of 1 mm and a length of 5 mm. This second, austenitic stainless steel had the following nominal composition: max. 0.030 C, 18.5 Cr and 9.5 Ni, balance iron and normal amounts of manganese, silicon, impurities and accessory elements. More particularly, the steel was of grade SS2352(ASTM 304L).

The powder of said first, martensitic stainless tool steel and the flakes of said second, austenitic stainless material were mixed and filled in a sheet capsule and the air was evacuated from the capsule. The capsule was closed and hot isostatic pressed at 1000 bar and 1150° C. for one hour with the result that the powder consisting of the first, martensitic stainless steel was forge welded to the flakes consisting of said second, austenitic stainless steel to form a consolidated, dense body. The body was hot worked to the shape of a round bar, diameter about 20 mm, which was forged to knife-blade dimnension, 25×4 mm. After grinding and etching the surface got a randomly varying pattern.

EXAMPLE 2

Figure 1:
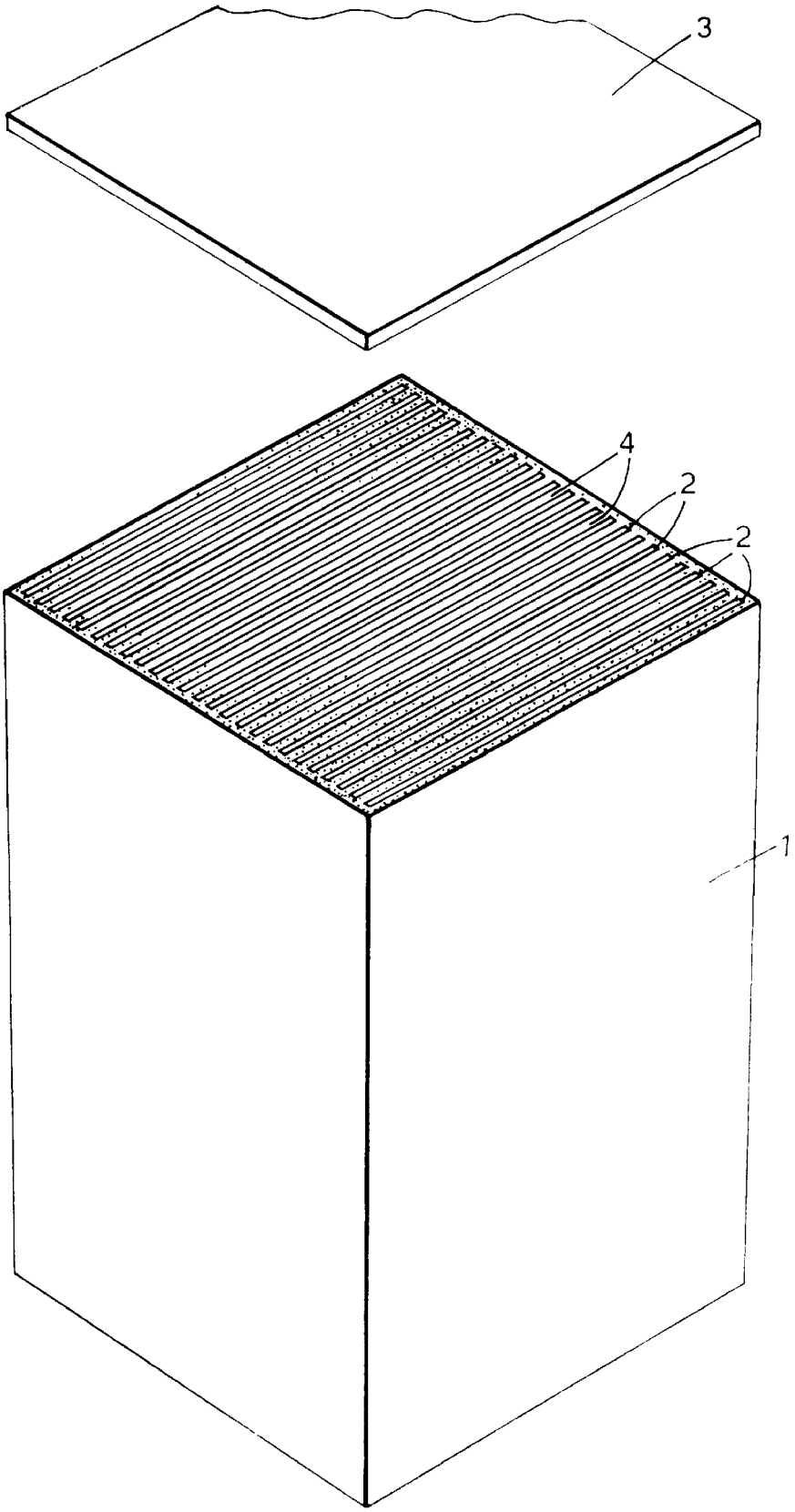
FIG. 1 is a perspective view which schematically illustrates a step in the manufacturing of a stratified compound material.

In a capsule 1, FIG. 1, of carbon steel, 25 plates, 2 mm thick were placed with a space of 3 mm between adjacent plates. The plates consisted of an austenitic stainless steel, grade SS2352(ASTM 304L) having the above given nominal composition. A powder 4 of the same martensitic stainless tool steel as in Example 1 were filled into the 3 mm broad spaces. The capsule 1 was closed by a lied 3, the air was evacuated, whereafter the capsule with its content was hot isostatic pressed at 1000 bar, 1150° C., 1 h to form a consolidated blank in which the martensitic stainless powder 4 and the plates 3 formed fifty layers welded together.

EXAMPLE 3

In this example, there was used a tool 6 of the type which is shown in FIG. 2–5. In the drawings, a cylinder is designated 7, having the outer size Ø250 mm. A circular plate 8 is deposited in the cylinder. From plate 8, a great number of sheet tubes extend vertically downwards, so that the lower edges of the tubes project slightly beneath the lower edge 9 of cylinder 7. The tubes 10 are elongated in a horizontal cross section and can be described as "flat channels". The channels 10 run parallel to each other symmetrically on each side of a plane of symmetry 11. Parallel spaces 12 are formed between the parallel channels 10. From the upper side of plate 8 two plates 13 extend vertically upwards parallel with and at a distance from the plane of symmetry 11. The two plates 13 are covered by a lid 14, so that a closed chamber 15 is defined. A supply conduit 17 is connected to the chamber 15.

Between the vertical plates, 13, i.e. in the region of chamber 15, the plate 8 is cut away except in those areas which cover the channels 10, which thus are closed in the region of the chamber 15. Thus, between the plates 13 there is formed a central opening 16 which is completely free in the central part of tool 6 but forms gaps 12' adjacent to the plates 13 and to an extended degree towards the cylinder 7.

In those parts of the tool which are formed as circular segments, on the opposite side of the walls 13, i.e. between the cylinder 7 and the walls 13, it is instead the elongated spaces 12" between the channels 10 which are closed by the plate 8 which is cut open and provided with elongated openings over the channels 10. Two second supply conduits 18 mouth above the thus exposed channels 10.

The tool 6 is placed in a cylindrical metal sheet capsule 20, the inner diameter of which is a few mm larger than the outer diameter of tool 6, so that the tool with sufficiently good fit can move relative the capsule 20. Capsule 20 is placed on a table 21 which can be moved in the vertical direction.

A first powder of the same type as the martensitic, stainless tool steel which was used in Example 1 is supplied through the first supply conduit 17. A second powder of the same austenitic stainless steel grade as in Example 1 (SS2352, ASTM 304L) is supplied through the two second supply conduits 18. The first powder flows from chamber 15 down into capsule 20 through the central openings 16 and out into the elongated spaces 12 between the channels 10, while the second powder which is supplied through the second supply conduits 18 flow down into the elongated channels 10 through the elongated openings in the plate 8. The table 21 with the capsule 20 is slowly lowered while the tool 6 is kept stationary. Through this relative movement, the capsule 20 will slowly be filled with the two powder into well defined, parallel layers in the capsule, corresponding to the patterns of the channels 10 and the lamellae 12 according to FIG. 2, while only non-mixed first powder will exist in the center of the capsule.

Figure 6:
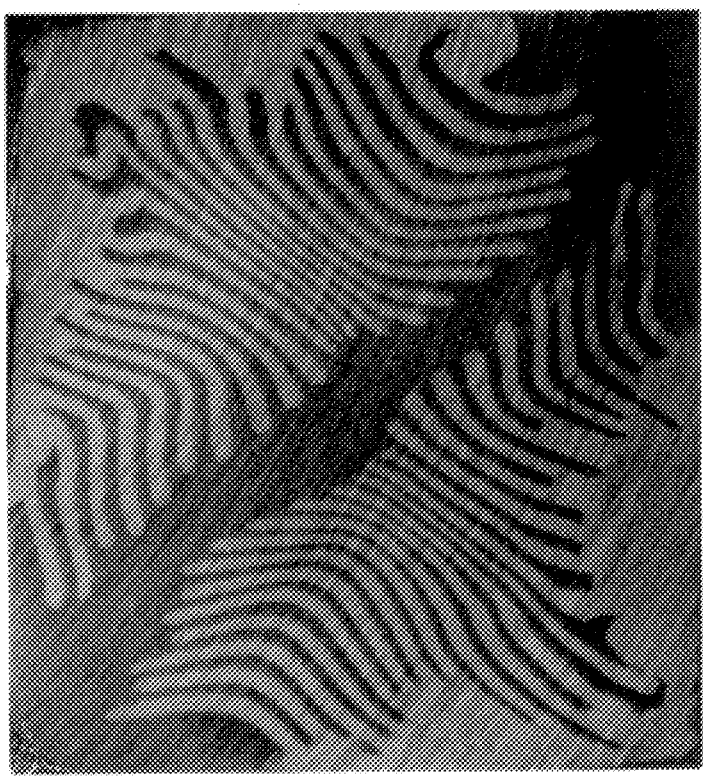
FIG. 6 is a cross section through a consolidated body produced through HIP-ing and subsequent forging to form a rod shaped blank.

When the capsule 20 thus had been filled with the first powder in the center of the capsule and with the two stratified powders in the rest of the capsule, respectively, it was provided with a lid which was secured by welding, whereupon the air was evacuated and also the evacuation opening was closed. Thereafter the filled capsule was subjected to hot isostatic pressing at 1150° C., 1000 bar, 1 h, so that the powder was compacted to a completely dense, consolidated body. During this compaction, the outer diameter of the capsule was reduced to about 220 mm This consolidated body was forged to 60 mm □. After this forging operation, one could observe an initial distortion of the original stratified structure which the two different stainless steel from in cross section, as is shown in FIG. 6.

Figure 7:
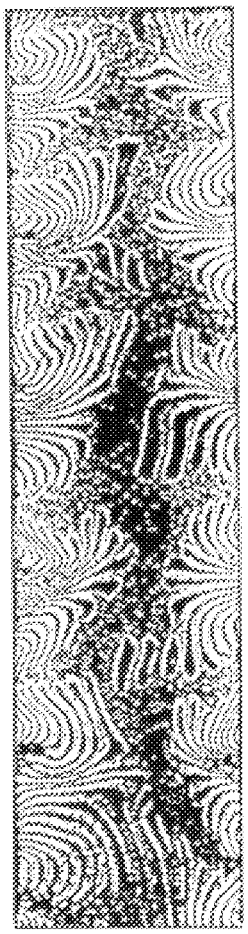
FIG. 7 shows a section of a strip made by rolling the blank shown in FIG. 6.
Figure 8:
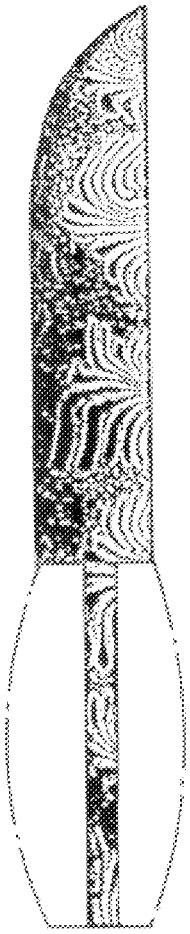
FIG. 8 shows a knife made of the strip shown in FIG. 7.

This blank was further worked through hot rolling to 18 mm Ø. This round bar then was twisted 40 turns/m about its own center axis, and the twisted bar thereafter was flat rolled to a thickness of about 4 mm. The strip thus obtained was ground and etched in acid. The shape of the pattern thus achieved is shown in FIG. 7. The strip then was cut along its center line and knife-blades were cut out from each half. That portion which forms the center portion in the strip prior to cutting was used as an edge material and consisted exclusively of the stainless, martensitic tool steel which originally formed the unmixed core in the consolidated body, while the rest of the blade consisted of the martensitic tool steel alternating with the austenitic stainless steel, such that the knife-blade after hardening obtained a very hard and wear resistant edge in combination with a good toughness and a high corrosion resistance of the knife-blade as a whole, and a damascened pattern which could be designed with great liberty and be given a high aesthetical value.

We claim:

1. Method relating to the manufacturing of a composite metal product comprising at least two stainless steel materials having different chemical compositions, which are bonded to each other through compaction treatment at a pressure exceeding 600 bar and a temperature exceeding 1000° C., at least one of said at least two stainless steel materials prior to said compaction consisting of a powder, wherein said at least two stainless steel materials are arranged in a capsule, the air is evacuated from the capsule, and the capsule thereafter is closed and subjected to said compaction treatment for the achievement of a consolidated body, said at least two stainless steel materials being arranged alternatingly in a plurality of layers in said capsule prior to said compaction treatment, and wherein said at least two stainless steel materials include a first and a second stainless steel, which first and second stainless steels have different compositions, one of the first and second stainless steels further colored through etching substantially more than the other of the first and second stainless steels.

2. Method according to claim 1, characterized in that the first stainless steel consists of a hardenable, martensitic, stainless steel, and the second stainless steel consists of an austenitic, ferrite, or ferrite-austenitic stainless steel or a of a martensitic stainless steel having a substantially lower carbon content than said first hardenable, martensitic, stainless steel.

3. Method according to claim 1 or 2, characterized in that the materials are bonded to each other through hot isostatic compaction.

4. Method according to claim 1, characterized in that at least one of said at least two stainless steel materials is homogeneous and has the shape of one or more strips or plates which are arranged in a capsule or form one or more walls of a capsule, and that said at least one powder shaped material is caused to contact said at least one homogeneous stainless steel material in the capsule form which the air is evacuated before the capsule is closed and subjected to said hot isostatic treatment for the achievement of a consolidated body.

5. Method according to claim 1, characterized in that one of the stainless steel materials, preferably a martensitic stainless steel, which has the shape of a powder, is provided between plates or strips of the other stainless steel material, said plates or strips being provided in said capsule or form one or more wall of it.

6. Method according to claim 1, characterized in that one of said stainless steel material consists of chips, flakes, shavings or similar irregularly shaped particles which are substantially larger than the grains of said at least one powder shaped stainless steel material in which said larger, irregularly formed particles are embedded prior to the compaction to a consolidated body.

7. Method according to claim 1–4, characterized in that stainless steel powders having different compositions are guided to different zones in the capsule, distributed over the internal cross section of the capsule via channels (10) or spaces (12) for respective type of powder, said channels and or spaces being elongated in cross section and alternating with each other, so that the powders of different types will form a plurality of elongated layers of different kinds of powder in the capsule, said layers after the compaction forming a stratified structure in the consolidated body.

8. Method according to claim 1, characterized in that only powder of a first stainless steel is supplied to a space around the center line of the capsule, and that to at least some parts of the regions outside said space there is supplied powder of the said first stainless steel in layers alternating with layers of a powder of a second stainless steel, so that after the compaction of the content of the capsule there is obtained a consolidated body which has a homogeneous core consisting of the first stainless steel and a region outside said core consisting of a great number of elongated layers of the first stainless steel alternating with layers of the second stainless steel, so that the consolidated body in said area will exhibit a stratified structure consisting of the two different stainless materials.

9. Method according to claim 1, characterized in that the consolidated body is subjected to plastic working through forging and or hot rolling so that the blank with reduced cross section is obtained.

10. Method according to claim 9, characterized in that the blank is deformed through plastic deformation so that any existing, substantially flat parallelism between the layers in said stratified structure is distorted, and that the blank having said distorted stratified structure thereafter is subjected to further plastic working through forging and/or hot rolling to finished dimension.

11. Method according to claim 10, characterized in that said distortion of the stratified structure in the blank prior to said final working to final dimension is achieved therein that the blank is worked with the lamellae standing on their edges and/or therein that the blank is twisted helically.

12. Method according to claim 9, charactized in that the blank is rolled to the shape of a strip.

13. Method according to claim 1, charactized in that one of the materials consists of a hardenable, martensitic, stainless steel.

14. Method according to claim 13, charactized in that the second of the materials consists of an austenitic, ferritic, or ferritic-austenitic stainless steel or of a martensitic stainless steel having a substantially lower carbon content than said first hardenable, martensitic, stainless steel.

15. Method according to claim 12, charactized in that the strip is cut into two halves along its center line and that the cut strip is used for the manufacturing of knifeblades, wherein the edge is made of a material adjacent to the cutting line of the strip, said material consisting of a material from said homogeneous core of said first stainless steel material, which consists of a hardenable, martensitic, stainless steel.

16. Method according to claim 13, charactized in that the said first martensitic, stainless steel contains 0.5 C, max. 1.0 Si, max. 1.0 Mn, 11–18 Cr, max. 5 Mo, totally max. 5 of V, NTb, W, balance substantially iron and impurities.

17. Method according to claim 16, charactized in that the high carbon martensitic stainless steel contains 0.6–1.3 carbon.

18. Method according to claim 1, charactized in that the martensitic stainless steel is provided in at least one layer in said capsule between layers of a different stainless steel having substantially different composition in order to give a pronounced contrast effect between the different steel grades through etching.

19. Method according to claim 18, charactized in that the martensitic, stainless steel, which is provided between the layers of stainless steel having a different composition in the capsule, has the shape of a powder.

20. Method relating to the manufacturing of a composite metal product comprising at least two stainless steel materials having different chemical compositions, which are bonded to each other through compaction treatment at a pressure exceeding 600 bar and a temperature exceeding 1000° C., at least one of said at least two stainless steel materials prior to said compaction consisting of a powder, wherein said at least two stainless steel materials are arranged in a capsule, the air is evacuated from the capsule, and the capsule thereafter is closed and subjected to said compaction treatment for the achievement of a consolidated body, said at least two stainless steel materials being arranged alternatingly in a plurality of layers in said capsule prior to said compaction treatment, and wherein said at least two stainless steel materials include a first and a second stainless steel, which first and second stainless steels have different compositions, while one of the first and second stainless steels can be colored through etching substantially more than the other of the first and second stainless steels, and wherein said consolidated body is forged or hot rolled into a blank, further wherein said blank is formed into the shape of a strip, which is cut into two halves along its center line and that the cut strip is formed into wherein the edge is made of a material adjacent to the cutting line of the strip, said material consisting of a material from said homogeneous core of said first stainless steel material, which consists of a hardenable, martensitic, stainless steel.

* * * * *